US011098458B2

(12) United States Patent
Kimura et al.

(10) Patent No.: US 11,098,458 B2
(45) Date of Patent: Aug. 24, 2021

(54) FLAP GATE

(71) Applicant: HITACHI ZOSEN CORPORATION, Osaka (JP)

(72) Inventors: Yuichiro Kimura, Osaka (JP); Kunie Miyamoto, Osaka (JP); Kyoichi Nakayasu, Osaka (JP); Toshiaki Morii, Osaka (JP)

(73) Assignee: HITACHI ZOSEN CORPORATION, Osaka (JP)

( * ) Notice: Subject to any disclaimer, the term of this patent is extended or adjusted under 35 U.S.C. 154(b) by 0 days.

(21) Appl. No.: 16/496,500

(22) PCT Filed: Dec. 22, 2017

(86) PCT No.: PCT/JP2017/046178
§ 371 (c)(1),
(2) Date: Oct. 23, 2019

(87) PCT Pub. No.: WO2018/173400
PCT Pub. Date: Sep. 27, 2018

(65) Prior Publication Data

US 2020/0048853 A1 Feb. 13, 2020

(30) Foreign Application Priority Data

Mar. 24, 2017 (JP) ..... JP2017-058906

(51) Int. Cl.
*E02B 7/44* (2006.01)
*E02B 7/20* (2006.01)
(Continued)

(52) U.S. Cl.
CPC ..... *E02B 7/44* (2013.01); *E02B 3/104* (2013.01); *E02B 7/205* (2013.01); *E02B 7/50* (2013.01)

(58) Field of Classification Search
CPC ..... E02B 7/44; E02B 7/40; E02B 3/104
See application file for complete search history.

(56) References Cited

U.S. PATENT DOCUMENTS 3,718,002 A * 2/1973 Aubert ..... E02B 7/44 405/102
2002/0021941 A1* 2/2002 Montgomery ..... E04B 1/7076 405/100
2012/0057935 A1* 3/2012 Lifton ..... E02B 15/0885 405/65
(Continued)

FOREIGN PATENT DOCUMENTS

CN 105484176 A 4/2016
JP 2004-300895 A 10/2004
(Continued)

OTHER PUBLICATIONS

International Search Report PCT/JP2017/046178 dated Apr. 3, 2018 with English translation.
(Continued)

*Primary Examiner* — Sean D Andrish
(74) *Attorney, Agent, or Firm* — Pillsbury Winthrop Shaw Pittman, LLP

(57) ABSTRACT

A flap gate includes a door body and a flap ancillary part. When the door body is in its down position, a movable end portion of the door body is located forward of a supported end portion. The door body changes its position between the down position and a maximum up position. The flap ancillary part applies tilt-up moment to the door body only when the door body is located in a position between the down position and a first position. The flap ancillary part also applies tilt-down moment to the door body only when the door body is located in a position between the maximum up position and a second position.

10 Claims, 12 Drawing Sheets

(51) Int. Cl.
*E02B 3/10* (2006.01)
*E02B 7/50* (2006.01)

(56) References Cited

U.S. PATENT DOCUMENTS

| | | | | |
|---|---|---|---|---|
| 2014/0140770 | A1* | 5/2014 | Nakayasu | E02B 7/44 405/107 |
| 2014/0328628 | A1* | 11/2014 | Nakayasu | E02B 7/205 405/26 |
| 2017/0044731 | A1 | 2/2017 | Yoshiki et al. | |

FOREIGN PATENT DOCUMENTS

| | | | |
|---|---|---|---|
| JP | 2010101097 | * | 5/2010 |
| JP | 2012-136839 | A | 7/2012 |
| JP | 2013-253381 | A | 12/2013 |
| JP | 2015-180806 | A | 10/2015 |
| JP | 2016-205077 | A | 12/2016 |
| JP | 2017-36595 | A | 2/2017 |
| KR | 10-1498470 | B1 | 3/2015 |

OTHER PUBLICATIONS

International Preliminary Report on Patentability and Written Opinion of the International Searching Authority dated Sep. 24, 2019 issued in corresponding International Application No. PCT/JP2017/046178 with English translation.

Notice of Reasons for Refusal dated Oct. 29, 2020 issued in corresponding Japanese Patent Application No. 2019-506943 with English translation (6 pgs.).

* cited by examiner

FLAP GATE

CROSS-REFERENCE TO RELATED APPLICATIONS

This Application is the U.S. National Stage of PCT/JP2017/046178, filed Dec. 22, 2017, which claims priority to Japanese Patent Application No. 2017-058906, filed Mar. 24, 2017, the contents of each of which are incorporated herein by reference in entirety.

TECHNICAL FIELD

The present invention relates to a flap gate that tilts up to block an opening when water flows in from the opening.

BACKGROUND ART

Flap gates provided in openings in breakwaters or other structures have conventionally been known. Among these flap gates, floating body type flap gates suppress the inflow of water into life space or the like by tilting up to block the openings under the pressure of water that flows in from the openings when the water level has risen due to hazards such as tidal waves. In the early stage of the water inflow, the water pressure acting on the flap gates is relatively low, and tilt-up motion of the flap gates is relatively gentle. When the water level has started to drop after the rise, the flap gates may not start their tilt-down motion until the water level drops to a certain degree, and thereafter may tilt down abruptly.

In view of this, the floating body type flap gate according to Japanese Patent Application Laid-Open No. 2015-180806 (Document 1) proposes a technique for mounting counterweights on a door body in order to accelerate tilt-up of the door body that is in a down position or to accelerate the start of tilt-down of the door body that is in an up position when the water level has started to drop. In the floating body type flap gate, ropes that include counterweights at their end portions are mounted on opposite end portions at the tip of the door body in the width direction through fixed pulleys. The counterweights are located at their lowest points when the inclination angle of the door body relative to a horizontal plane becomes a predetermined angle. Therefore, when the door body is located in a position between the down position and an up position at the predetermined angle, tilt-up moment produced by the counterweights is applied to the door body, and when the door body is located in a position between the up position at the predetermined angle and a maximum up position, tilt-down moment produced by the counterweights is applied to the door body.

Incidentally, in some of the flap gates provided in breakwaters or other structures, vehicles or the like may run over the door body that is in the down position, in cases other than a rise in water level. Since such a flap gate needs to increase the strength of the door body, the weight of the door body will increase. Therefore, if the structure of Document 1 is applied, the weight of the counterweights will increase. This consequently limits the span length of the door body, or increases the thickness of the door body due to the necessity of ensuring a cross section for members at the tip of the door body.

SUMMARY OF INVENTION

The present invention is intended for a flap gate that is provided in an opening and tilts up to block the opening when water flows in from the opening, and it is an object of the present invention to simplify the structure of the flap gate.

A flap gate according to the present invention includes a door body whose movable end portion is located forward of its supported end portion, i.e., on a side from which water flows in, when the door body is in a down position, and that changes its position between the down position and a maximum up position by turning on the supported end portion serving as a support, and a flap ancillary part that applies tilt-up moment to the door body only when the door body is located in a position between the down position and a first position that is between the down position and the maximum up position, and applies tilt-down moment to the door body only when the door body is located in a position between the maximum up position and a second up position that is between the first position and the maximum up position. Accordingly, it is possible to simplify the structure of the flap gate.

In a preferable embodiment of the present invention, the flap ancillary part is disposed on a lower side of an upper surface of the door body that is in the down position.

In another preferable embodiment of the present invention, the flap ancillary part includes a tilt-up elastic member that is fixed to either a floor surface or the door body. The tilt-up elastic member is contracted in an up-down direction when the door body is located in a position between the down position and the first position.

More preferably, the tilt-up elastic member is a coil spring that expands and contracts along a central axis. The coil spring includes a plurality of spring elements that are connected in series and that overlap in a direction perpendicular to the central axis when the coil spring is not expanded.

In yet another preferable embodiment of the present invention, the flap ancillary part includes a tilt-down elastic member that is a string- or band-like elastomeric resin member having opposite end portions fixed respectively to a floor surface and the door body and that is expandable and contractible in a longitudinal direction, and a string- or band-like tilt-up limit member having opposite end portions fixed respectively to the floor surface and the door body. The tilt-down elastic member is expanded when the door body is located in a position between the second position and the maximum up position. The tilt-up limit member extends linearly when the door body is in the maximum up position.

More preferably, the flap ancillary part further includes another tilt-up limit member that is disposed at a different location in a width direction from a location of the tilt-up limit member. The other tilt-up limit member is a string- or band-like member having opposite end portions fixed respectively to the floor surface and the door body. The other tilt-up limit member extends linearly when the door body is in the maximum up position. The tilt-up limit member and the another tilt-up limit member have individually adjustable lengths.

Another flap gate according to the present invention includes a door body whose movable end portion is located forward of its supported end portion when the door body is in a down position, and that changes its position between the down position and a maximum up position by turning on the supported end portion serving as a support, and a tilt-up ancillary part that applies tilt-up moment to the door body only when the door body is located in a position between the down position and a first position that is between the down position and the maximum up position. The tilt-up ancillary part includes a tilt-up elastic member that is disposed on a lower side of an upper surface of the door body in the down position and that is fixed to either a floor surface or the door body. The tilt-up elastic member is contracted in an up-down direction when the door body is located in a position between the down position and the first position. The tilt-up elastic member is a coil spring that expands and contracts along a central axis. The coil spring includes a plurality of spring elements that are connected in series and that overlap in a direction perpendicular to the central axis when the coil spring is not expanded. Accordingly, it is possible to simplify the structure of the flap gate.

Yet another flap gate according to the present invention includes a door body whose movable end portion is located forward of its supported end portion when the door body is in a down position, and that changes its position between the down position and a maximum up position by turning on the supported end portion serving as a support, and a tilt-down ancillary part that applies tilt-down moment to the door body only when the door body is located in a position between the maximum up position and a second up position that is between the down position and the maximum up position. The tilt-down ancillary part is disposed on a lower side of an upper surface of the door body that is in the down position. The tilt-down ancillary part includes a tilt-down elastic member that is a string- or band-like elastomeric resin member having opposite end portions fixed respectively to a floor surface and the door body, and that is expandable and contractible in a longitudinal direction, and a tilt-up limit member that is a string- or band-like member having opposite end portions fixed respectively to the floor surface and the door body. The tilt-down elastic member is expanded when the door body is located in a position between the second position and the maximum up position. The tilt-up limit member extends linearly when the door body is in the maximum up position. Accordingly, it is possible to simplify the structure of the flap gate.

These and other objects, features, aspects and advantages of the present invention will become more apparent from the following detailed description of the present invention when taken in conjunction with the accompanying drawings.

DESCRIPTION OF EMBODIMENTS

Figure 1:
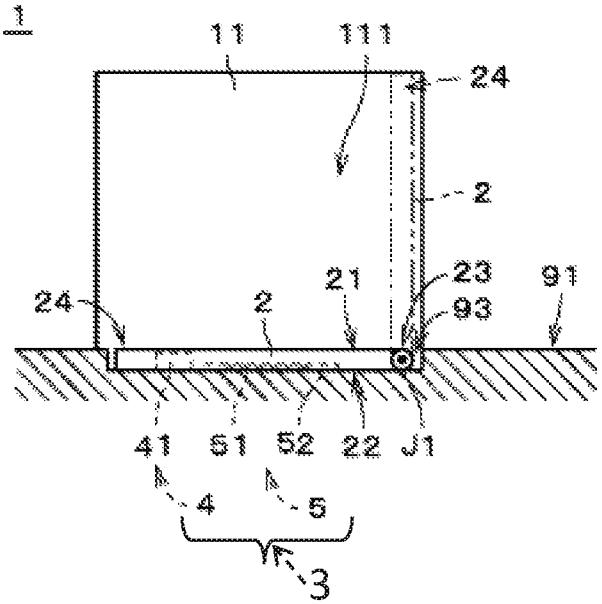
FIG. 1 is a side view of a flap gate according to a first embodiment.
Figure 2:
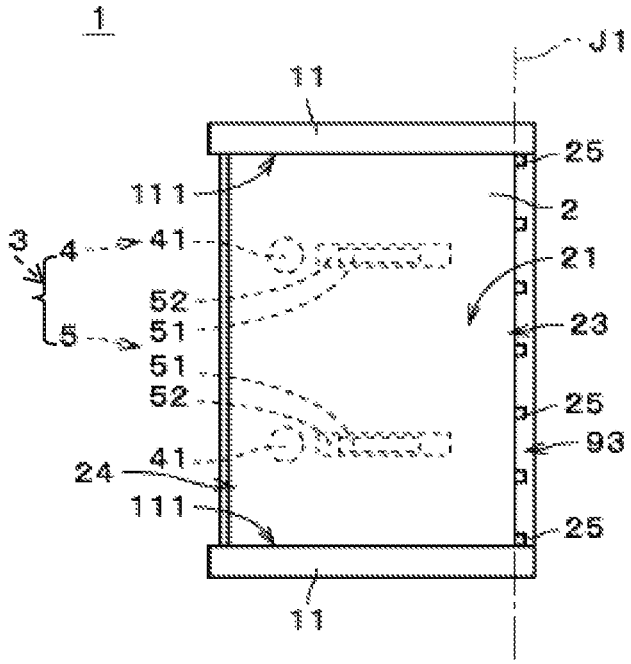
FIG. 2 is a plan view of the flap gate.
Figure 3:
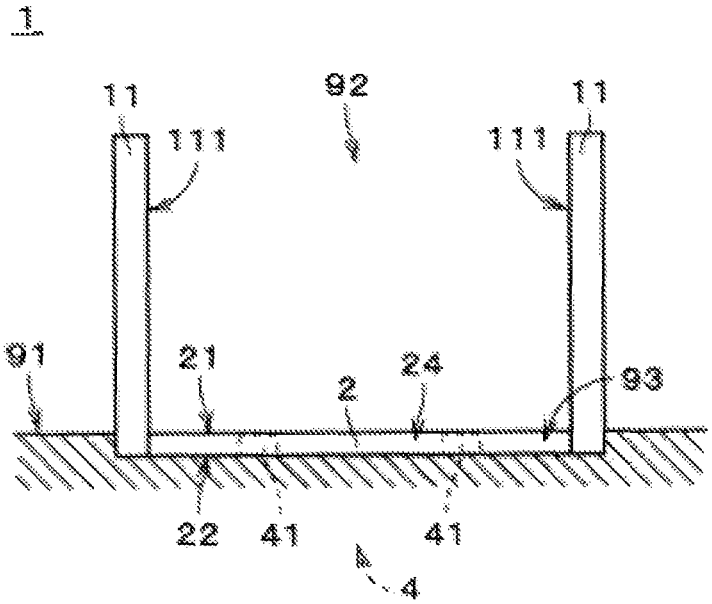
FIG. 3 is a front view of the flap gate.

FIG. 1 is a side view of a flap gate 1 according to a first embodiment of the present invention. FIG. 2 is a plan view of the flap gate 1. FIG. 3 is a front view of the flap gate 1 as viewed from the front. The flap gate 1 is a floating body type flap gate. For example, the flap gate 1 is provided on a floor surface 91 (e.g., road surface) in an opening 92 of an embankment. When water flows in from the opening 92 due to a rise in water level, the flap gate 1 tilts up to block the opening 92 under the pressure of the water flowing in so as to suppress the inflow of the water from the opening 92 into life space or the like. In the example illustrated in FIG. 1, the floor surface 91 extends approximately horizontally (i.e., approximately perpendicularly to the direction of the earth's gravity).

In the following description, the side of the flap gate 1 from which water flows in when the water level has risen (i.e., the upstream side in the direction of water inflow; e.g., the waterfront side of the flap gate 1 in the sea or a river) is referred to as a "front side," and the downstream side of the flap gate 1 in the direction of water inflow (e.g., the land side of the flap gate 1) is referred to as a "rear side." That is, the right-left direction in FIGS. 1 and 2 corresponds to the "front-rear direction," and the left and right sides in FIGS. 1 and 2 are "front and rear sides," respectively. The up-down direction in FIG. 2 and the right-left direction in FIG. 3 are referred to as a "width direction." The width direction is perpendicular to the front-rear direction, and the front-rear direction and the width direction are perpendicular to the up-down direction. The up-down direction in FIGS. 1 and 3 is approximately parallel to the direction of the earth's gravity.

The flap gate 1 includes a door body 2, a pair of door abutting parts 11, and a flap ancillary part 3. The door body 2 illustrated in FIGS. 1 to 3 is a generally rectangular parallelepiped member that extends in the front-rear direction and in the width direction. FIGS. 1 to 3 illustrate the door body 2 that is down on the floor surface 91. In the following description, the position of the door body 2 indicated by the solid line in FIG. 1 is referred to as a "down position." The door body 2 in the down position is housed in a recess 93 formed in the floor surface 91. The recess 93 is slightly larger than the door body 2 in the down position in plan view.

The position in the up-down direction of the upper surface (hereinafter, referred to as a "first main surface 21") of the door body 2 that is in the down position is approximately the same as the position in the up-down direction of the floor surface 91 around the recess 93. For example, vehicles or the like are capable of running over the first main surface 21 when the door body 2 is in the down position. The lower surface (hereinafter, referred to as a "second main surface 22") of the door body 2 that is in the down position is in contact with or in close proximity to the bottom surface of the recess 93 in the floor surface 91. In the case where no plate material (i.e., plate material that extends in the front-rear direction and in the width direction) is provided on the lower end of the door body 2 in the down position, the second main surface 22 of the door body 2 means the soffit surface of a girder member or the like that extends downward from the first main surface 21. In the example illustrated in FIG. 1, the bottom surface of the recess 93, which forms part of the floor surface 91, also extends approximately horizontally.

Inside the door body 2 (i.e., between the first main surface 21 and the second main surface 22), for example, a floating part is provided. The floating part includes, for example, a floating body such as a foam resin that is disposed in the space between the first main surface 21 and the second main surface 22. Alternatively, the floating part may include a watertight space provided between the first main surface 21 and the second main surface 22.

A rear end portion 23 of the door body 2 in the down position is rotatably mounted on the floor surface 91 in the recess 93 and supported by the floor surface 91. In the following description, the rear end portion 23 of the door body 2 in the down position is referred to as a "supported end portion 23." Also, a front end portion 24 of the door body 2 in the down position is referred to as a "movable end portion 24." That is, when the door body 2 is in the down position, the movable end portion 24 is located forward of the supported end portion 23. In the following description, a direction that is perpendicular to the width direction and that connects the supported end portion 23 and movable end portion 24 of the door body 2 is referred to as a "longitudinal direction" of the door body 2. When the door body 2 is in the down position, the longitudinal direction of the door body 2 is the same as the front-rear direction.

The door body 2 turns clockwise in FIG. 1 about a rotation axis J1 that extends approximately parallel to the width direction at the supported end portion 23, so that the movable end portion 24 tilts up while being separated above from the floor surface 91. The supported end portion 23 of the door body 2 includes, for example, a plurality of turn supporters 25 that are aligned apart from each other in the width direction. For example, the rotation axis J1 extends in the width direction while passing through approximately the centers of the turn supporters 25.

In the example illustrated in FIG. 1, the door body 2 is capable of tilting up to a position at which the movable end portion 24 and the supported end portion 23 are aligned in the up-down direction as indicated by the chain double-dashed line. In other words, the door body 2 is capable of tilting up until its angle formed with the floor surface 91 becomes approximately 90 degrees. In the following description, the position of the door body 2 indicated by the chain double-dashed line in FIG. 1 is referred to as a "maximum up position." In the flap gate 1, the door body 2 changes its position between the down position and the maximum up position by turning on the supported end portion 23 serving as a support. Note that the angle formed by the floor surface 91 and the door body 2 in the maximum up position may be smaller than 90 degrees.

The pair of door abutting parts 11 is each disposed on each side of the door body 2 in the width direction. In FIG. 1, the door abutting part 11 on the frontward side of the door body 2 is not shown. As illustrated in FIG. 3, the space between the pair of door abutting parts 11 corresponds to the aforementioned opening 92. The door abutting parts 11 are, for example, generally plate-like structures. For example, a breakwater is provided on the outer side in the width direction of the pair of door abutting parts 11, and the pair of door abutting parts 11 is fixed to the breakwater.

The side faces of the door body 2 are in contact with door contact surfaces 111 that are internal side faces of the door abutting parts 11 in the width direction. To be more specific, a sealing member (e.g., watertight rubber), which is not shown, is provided along approximately the entire length of the door body 2 in the longitudinal direction on opposite side faces of the door body 2 in the width direction. The door body 2 is in contact with the door contact surfaces 111 of the door abutting parts 11 via the sealing member. The sealing member establishes watertight sealing of the space between the door body 2 and the door abutting parts 11. In the flap gate 1, the side faces of the door body 2 are in contact with the door contact surfaces 111, irrespective of the position of the door body 2, so as to maintain watertightness of the space between the door body 2 and the door abutting parts 11.

The flap ancillary part 3 includes a tilt-up ancillary part 4 and a tilt-down ancillary part 5. The tilt-up ancillary part 4 and tilt-down ancillary part 5 of the flap ancillary part 3 are disposed on the lower side of the first main surface 21 of the door body 2 that is in the down position. In other words, the flap ancillary part 3 overlaps in the up-down direction with the door body 2 in the down position in plan view.

The tilt-up ancillary part 4 includes two tilt-up elastic members 41. The two tilt-up elastic members 41 are disposed apart from each other in the width direction at approximately the same location in the front-rear direction. The two tilt-up elastic members 41 have the same structure. The number of tilt-up elastic members 41 included in the tilt-up ancillary part 4 may be appropriately changed. For example, the number of tilt-up elastic members 41 may be one, or may be three or more.

Figure 4:
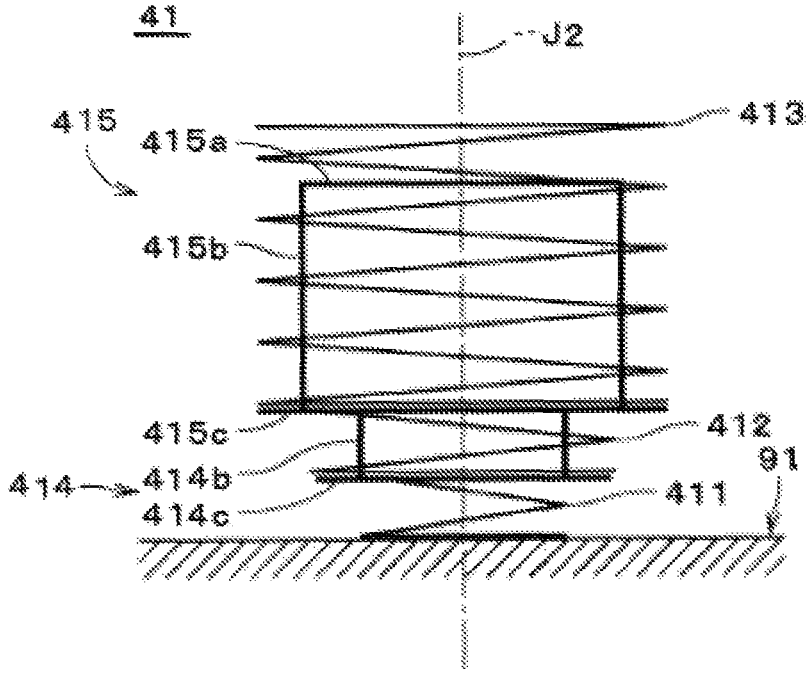
FIG. 4 is a front view of a tilt-up elastic member.
Figure 5:
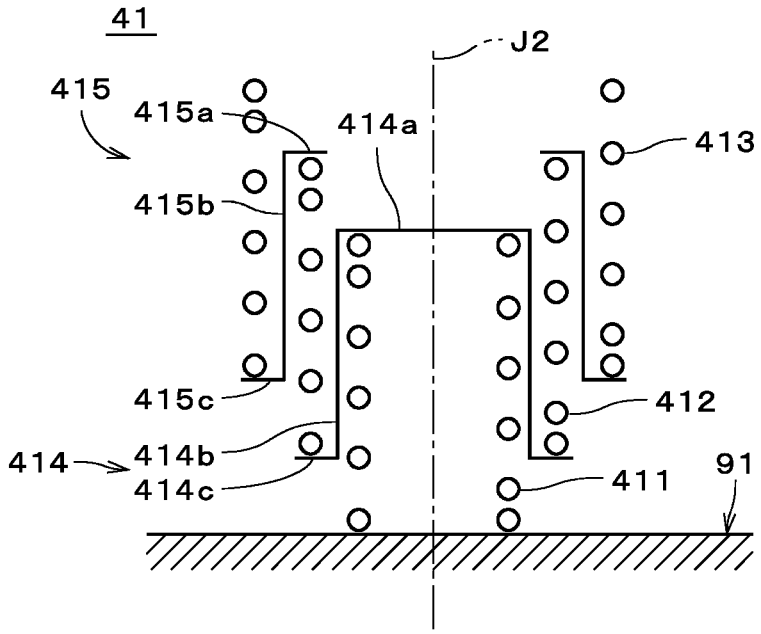
FIG. 5 is a longitudinal sectional view of the tilt-up elastic member.
Figure 6:
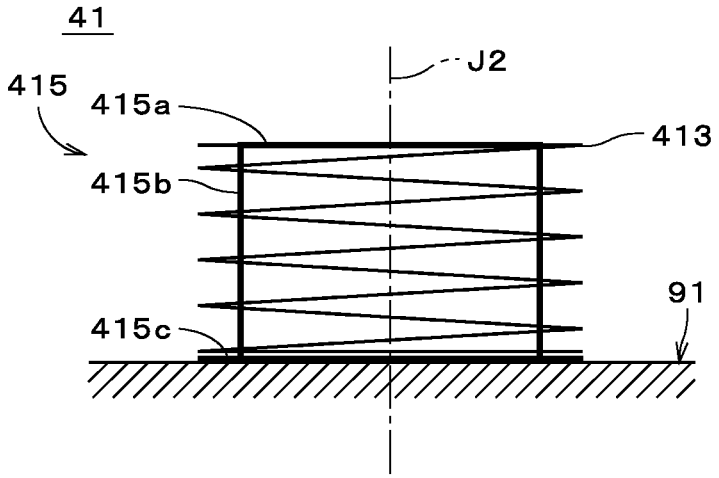
FIG. 6 is a front view of the contracted tilt-up elastic member.
Figure 7:
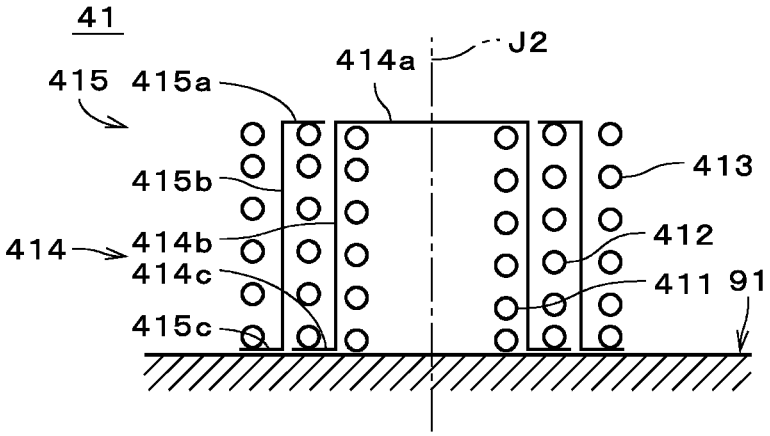
FIG. 7 is a longitudinal sectional view of the contracted tilt-up elastic member.

FIGS. 4 and 5 are respectively a front view and a longitudinal sectional view of one tilt-up elastic member 41 when the tilt-up elastic member 41 has its equilibrium length. FIGS. 6 and 7 are respectively a front view and a longitudinal sectional view of the tilt-up elastic member 41 that is contracted in the up-down direction. In FIGS. 5 and 7, cross hatch lines in the section of the tilt-up elastic member 41 are not shown. The tilt-up elastic member 41 is a coil spring (i.e., spiral spring) that expands and contracts along a central axis J2 extending in the up-down direction. The coil spring includes a plurality of spring elements 411, 412, and 413 and connection members 414 and 415.

The spring element 411 is located inward of the spring element 412 in a radial direction about the central axis J2 (hereinafter, also simply referred to as a "radial direction"). The spring element 412 is located radially inward of the spring element 413. The spring elements 411 and 412 are connected in series by the connection member 414. The spring elements 412 and 413 are connected in series by the connection member 415. The connection members 414 and 415 substantially do not expand and contract in the up-down direction.

In the example illustrated in FIGS. 4 to 7, the connection member 414 includes a canopy part 414*a*, a cylinder part 414*b*, and a lower flange part 414*c*. The canopy part 414*a* is an area having a generally disc shape about the central axis J2. The lower surface of the canopy part 414*a* is connected to the upper end portion of the spring element 411. The cylinder part 414*b* is an area having a generally cylindrical shape about the central axis J2, and extends downward from the outer periphery of the canopy part 414*a*. The cylinder part 414*b* is located between the spring elements 411 and 412 in the radial direction. The lower flange part 414*c* is an area having a generally annular plate-like shape about the central axis J2, and extends radially outward from the lower end portion of the cylinder part 414*b*. The upper surface of the lower flange part 414*c* is connected to the lower end portion of the spring element 412.

The connection member 415 includes an upper flange part 415*a*, a cylinder part 415*b*, and a lower flange part 415*c*. The upper flange part 415*a* is an area having a generally annular plate-like shape about the central axis J2. The lower surface of the upper flange part 415*a* is connected to the upper end portion of the spring element 412. The cylinder part 415*b* is an area having a generally cylindrical shape about the central axis J2, and extends downward from the outer periphery of the upper flange part 415*a*. The cylinder part 415*b* is located between the spring elements 412 and 413 in the radial direction. The lower flange part 415*c* is an area having a generally annular plate-like shape about the central axis J2, and extends radially outward from the lower end portion of the cylinder part 415*b*. The upper surface of the lower flange part 415*c* is connected to the lower end portion of the spring element 413.

When the tilt-up elastic member 41 has its equilibrium length as illustrated in FIGS. 4 and 5, the lower end of the spring element 412 is located between the upper and lower ends of the spring element 411, and the lower end of the spring element 413 is located between the upper and lower ends of the spring element 412. When the tilt-up elastic member 41 is contracted as illustrated in FIGS. 6 and 7, the lower ends of the spring elements 412 and 413 are located at approximately the same location in the up-down direction as the lower end of the spring element 411, and the upper ends of the spring elements 412 and 413 are located at approximately the same location in the up-down direction as the upper end of the spring element 411. That is, when the tilt-up elastic member 41 is not expanded, the spring elements 411 to 413 overlap each other in the radial direction perpendicular to the central axis J2.

The lower end portion of the tilt-up elastic member 41 (i.e., the lower end portion of the spring element 411) is fixed to the bottom surface of the recess 93. The upper end portion of the tilt-up elastic member 41 (i.e., the upper end portion of the spring element 413) is a free end that is not fixed to the door body 2. Note that the top and bottom of the tilt-up elastic member 41 in FIGS. 4 to 7 do not necessarily have to coincide with the top and bottom of the tilt-up elastic member 41 when mounted on the floor surface 91, and the tilt-up elastic member 41 may be mounted such that the top and bottom illustrated in FIGS. 4 to 7 are reversed.

When the door body 2 is in the down position, each tilt-up elastic member 41 is contracted in the up-down direction due to the weight of the door body 2, i.e., contracted as illustrated in FIGS. 6 and 7. The tilt-up elastic members 41 are located inside the door body 2 that is in the down position, as illustrated in FIG. 1. In other words, the upper ends of the tilt-up elastic members 41 are located between the first main surface 21 and the second main surface 22 in the up-down direction of the door body 2 in the down position. In the example illustrated in FIG. 1, approximately the whole of the tilt-up elastic members 41 is located inside the door body 2 in the down position.

The tilt-down ancillary part 5 includes a tilt-down elastic member 51 and a tilt-up limit member 52. In the example illustrated in FIG. 2, two sets of the tilt-down elastic member 51 and the tilt-up limit member 52 are disposed apart from each other in the width direction at approximately the same location in the front-rear direction. The two sets of the tilt-down elastic member 51 and the tilt-up limit member 52 have the same structure. The number of tilt-down elastic members 51 and the number of tilt-up limit members 52, included in the tilt-down ancillary part 5, may be appropriately changed. For example, the number of tilt-down elastic members 51 and the number of tilt-up limit member 52 may be one, or may be three or more.

Figure 8:
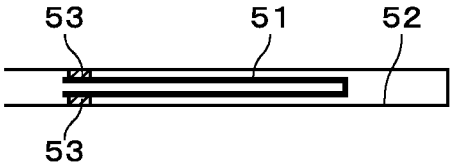
FIG. 8 is a side view of a tilt-down elastic member and a tilt-up limit member.
Figure 9:
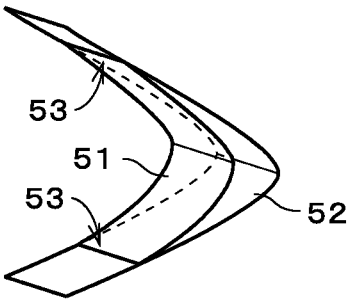
FIG. 9 is a perspective view of the tilt-down elastic member and the tilt-up limit member.

FIG. 8 is a side view of one set of the tilt-down elastic member 51 and the tilt-up limit member 52. The tilt-down elastic member 51 and the tilt-up limit member 52 in FIG. 8 are folded in two in a central portion in the longitudinal direction. FIG. 9 is a perspective view of the one set of the tilt-down elastic member 51 and the tilt-up limit member 52 that are slightly opened. The tilt-down elastic member 51 is a string- or band-like elastomeric resin member that is expandable and contractible in the longitudinal direction. The tilt-up limit member 52 is a string- or band-like member that substantially does not expand and contract in the longitudinal direction. The tilt-down elastic member 51 is, for example, a band-like member made of rubber. The tilt-up limit member 52 is, for example, a band-like member made of synthetic fiber.

Opposite end portions of the tilt-down elastic member 51 in the longitudinal direction are fixed to the tilt-up limit member 52. In the example illustrated in FIGS. 8 and 9, the opposite end portions of the tilt-down elastic member 51 are fixed at positions that are spaced from opposite end portions of the tilt-up limit member 52 in the longitudinal direction. In the following description, the areas where the end portions of the tilt-down elastic member 51 are fixed to the tilt-up limit member 42 are referred to as "bonded parts 53." The length of the tilt-up limit member 52 between the two bonded parts 53 is longer than the equilibrium length of the tilt-down elastic member 51.

The opposite end portions of the tilt-up limit member 52 in the longitudinal direction are fixed respectively to the floor surface 91 and the door body 2. The connection between the floor surface 91 and the end portion of the tilt-up limit member 52 is at a location that is spaced forward from the rotation axis J1. The connection between the door body 2 and the end portion of the tilt-up limit member 52 is at a location that is spaced from the rotation axis J1 in the longitudinal direction of the door body 2. The opposite end portions of the tilt-down elastic member 51 in the longitudinal direction are indirectly fixed respectively to the floor surface 91 and the door body 2 via the tilt-up limit member 52. That is, the tilt-down elastic member 51 is a string- or band-like elastomeric resin member having opposite end portions fixed respectively to the floor surface 91 and the door body 2. The two tilt-up limit members 52 have individually adjustable lengths. Preferably, the lengths of the tilt-up limit members 52 are adjustable without going through steps. Various methods for adjusting the lengths of string- or band-like members may be employed to adjust the lengths of the tilt-up limit members 52. For example, each tilt-up limit member 52 may include a length adjusting mechanism having approximately the same structure as the structure of the buckles of belts worn around the waists.

When the door body 2 is in the down position, the tilt-down elastic members 51 and the tilt-up limit members 52 are disposed approximately parallel to the front-rear direction, while folded in two with the tilt-down elastic members 51 inward. As illustrated in FIG. 1, the tilt-down elastic members 51 and the tilt-up limit members 52 are located inside the door body 2 in the down position. In FIG. 1, the thicknesses of the tilt-down elastic members 51 and the tilt-up limit members 52 are shown greater than the actual thicknesses. If a gap exists between the floor surface 91 and the door body 2 in the down position, the tilt-down elastic members 51 and the tilt-up limit members 52 may be disposed in that gap.

Next, how the door body 2 tilts up will be described with reference to FIGS. 10 to 14. FIG. 15 illustrates the relation between the position of the door body 2 and the moment acting on the door body 2. The horizontal axis in FIG. 15 indicates the angle of the door body 2 relative to the floor surface 91 (hereinafter, simply referred to as the "angle of the door body 2"). When the door body 2 is in the down position, the angle of the door body 2 is 0 degrees, and when the door body 2 has tilted up to a position perpendicular to the floor surface 91, the angle of the door body 2 is 90 degrees. The longitudinal axis in FIG. 15 indicates moment that acts on the door body 2 about the rotation axis J1, where counterclockwise moment in FIG. 1 is regarded as positive moment. That is, positive moment in FIG. 15 refers to moment (hereinafter, referred to as "tilt-down moment") that acts in a direction in which the door body 2 is caused to tilt down, and negative moment refers to moment (hereinafter, referred to as a "tilt-up moment") that acts in a direction in which the door body 2 is caused to tilt up.

A broken line 81 in FIG. 15 indicates moment that is produced by the weight of the door body 2, and a solid line 82 indicates moment that is applied from the tilt-up ancillary part 4 to the door body 2. A solid line 83 in FIG. 15 indicates moment that is applied from the tilt-down ancillary part 5 to the door body 2, and a thick solid line 84 indicates the total moment obtained by summing the lines 81 to 83. When the angle of the door body 2 is 0 degrees (i.e., the door body 2 is in the down position), the absolute value of tilt-down moment produced by the weight of the door body 2 is greater than the absolute value of tilt-up moment produced by the contracted tilt-up elastic members 41.

Figure 10:
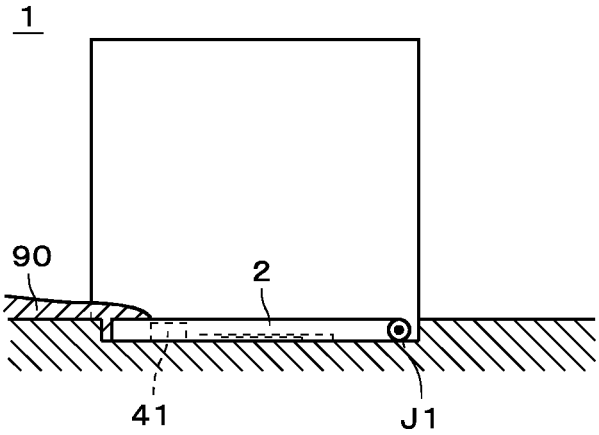
FIG. 10 is a side view of the flap gate.

When water 90 flows into the flap gate 1 as illustrated in FIG. 10, tilt-up moment is applied to the door body 2 due to, for example, buoyancy exerted on the door body 2 by the water 90, and the door body 2 starts to tilt up. At this time, in addition to the tilt-up moment produced by the water 90, the tilt-down moment produced by the weight of the door body 2 and the tilt-up moment produced by the restoring force of the tilt-up elastic members 41 act on the door body 2.

Figure 11:
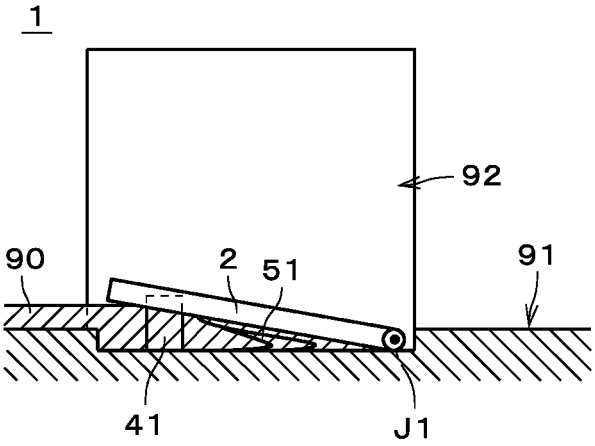
FIG. 11 is a side view of the flap gate.

The tilt-up moment produced by the tilt-up elastic members 41 continues to act on the door body 2 until the angle of the door body 2 changes from 0 degrees to a predetermined first angle illustrated in FIG. 11. This assists the tilt-up of the door body 2 and increases the tilt-up speed of the door body 2. As a result, it is possible to suppress the inflow of the water 90 from the opening 92 beyond the door body 2. In the following description, the position of the door body 2 illustrated in FIG. 11 is referred to as a "first position." The first angle formed by the door body 2 in the first position and the floor surface 91 (i.e., the bottom surface of the recess 93) is larger than 0 degrees and smaller than the angle formed by the floor surface 91 and the door body 2 in the maximum up position (approximately 90 degrees in the above-described example). In other words, the first position is a position between the down position and the maximum up position. The first angle is, for example, larger than or equal to 5 degrees and less than or equal to 20 degrees. In the example illustrated in FIG. 11, the first angle is approximately 10 degrees.

When the door body 2 is located in a position between the down position and the first position, the lengths of the contracted tilt-up elastic members 41 in the up-down direction gradually increase and the absolute value of the tilt-up moment applied from the tilt-up elastic members 41 to the door body 2 gradually decreases as the angle of the door body 2 increases. When the door body 2 has tilted up to the first position, the contraction of the tilt-up elastic member 41 is released, and the lengths of the tilt-up elastic members 41 become approximately their equilibrium lengths.

When the door body 2 has further tilted up from the first position, the tilt-up elastic members 41 are separated from the door body 2, and accordingly no moment is applied from the tilt-up elastic members 41 to the door body 2. When the door body 2 is located in a position between the down position and the first position, the tilt-down elastic members 51 and the tilt-up limit members 52 of the tilt-down ancillary part 5 are loosened, and substantially no moment is applied from the tilt-down ancillary part 5 to the door body 2.

Figure 12:
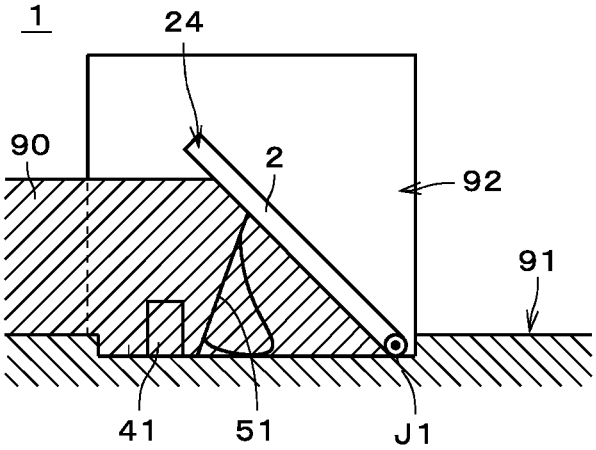
FIG. 12 is a side view of the flap gate.

When the door body 2 has further tilted up so that the angle of the door body 2 becomes a predetermined second angle illustrated in FIG. 12, the tilt-down elastic members 51 extend linearly to their equilibrium lengths without looseness. In the following description, the position of the door body 2 illustrated in FIG. 12 is referred to as a "second position." The second angle formed by the floor surface 91 and the door body 2 in the second position is larger than the first angle and smaller than the angle formed by the floor surface 91 and the door body 2 in the maximum up position. In other words, the second position is a position between the first position and the maximum up position. The second angle is, for example, larger than or equal to 20 degrees and less than or equal to 90 degrees. In the example illustrated in FIG. 12, the second angle is approximately 45 degrees.

When the door body 2 is located in a position between the first position and the second position, the tilt-down elastic members 51 have their equilibrium lengths, and substantially no moment is applied from the tilt-down elastic members 51 to the door body 2. The tilt-up elastic members 41 are separated from the door body 2, and accordingly no moment is applied from the tilt-up elastic members 41 to the door body 2. Here, the tilt-up moment produced by the water 90 and the tilt-down moment produced by the weight of the door body 2 act on the door body 2.

Figure 13:
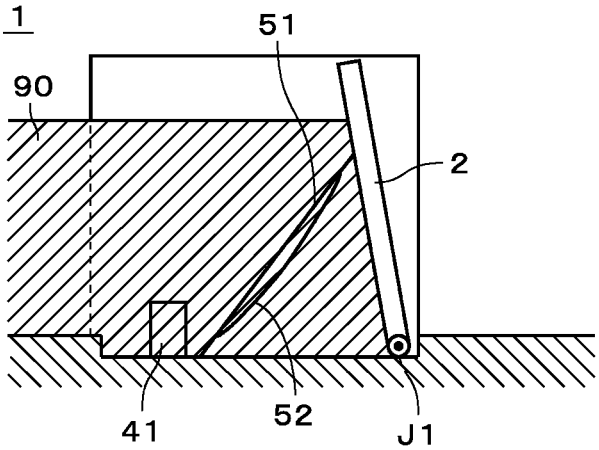
FIG. 13 is a side view of the flap gate.

When the door body 2 has further tilted up from the second position, the tilt-down elastic members 51 are expanded to lengths longer than their equilibrium lengths as illustrated in FIG. 13. Accordingly, tilt-down moment produced by the restoring force of the tilt-down elastic members 51 acts on the door body 2. When the door body 2 is located in a position between the second position and the maximum up position, the lengths of the tilt-down elastic members 51 gradually increase and the absolute value of the tilt-down moment applied from the tilt-down elastic members 51 to the door body 2 gradually increases as the angle of the door body 2 increases.

When the door body 2 is located in a position between the second position and the maximum up position, the tilt-up moment produced by the water 90, the tilt-down moment produced by the weight of the door body 2, and the tilt-down moment produced by the tilt-down elastic members 51 act on the door body 2. The tilt-up elastic members 41 are separated from the door body 2, and accordingly no moment is applied from the tilt-up elastic members 41 to the door body 2. The tilt-up limit members 52 are loosened.

Figure 14:
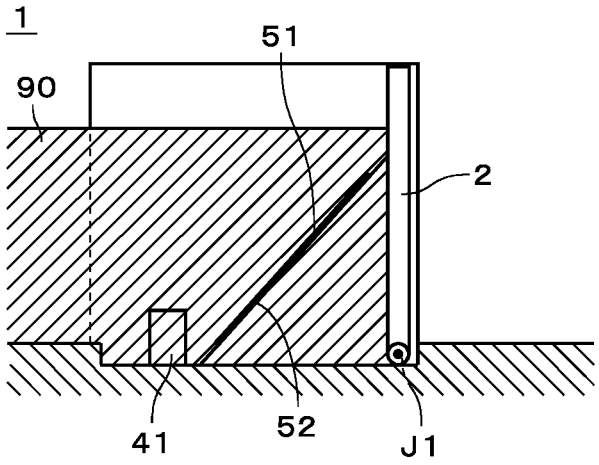
FIG. 14 is a side view of the flap gate.
Figure 15:
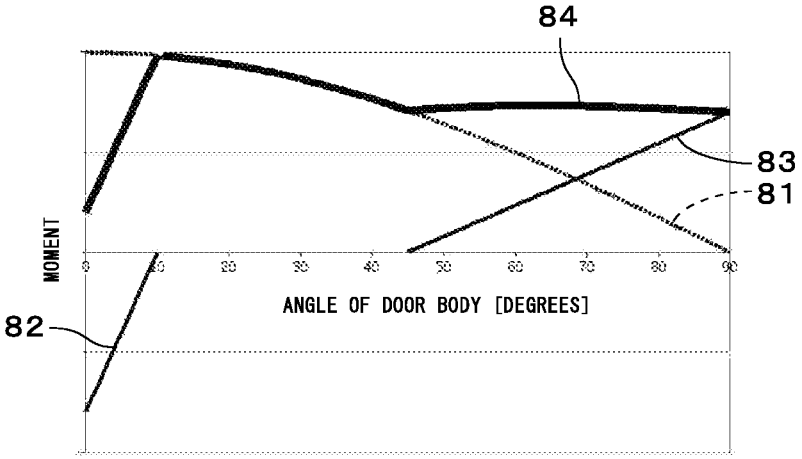
FIG. 15 illustrates a relationship between the position of a door body and moment acting on the door body.

When the door body 2 has tilted up to the maximum up position as illustrated in FIG. 14, the tilt-up limit members 52 extend linearly without looseness. The tilt-up limit members 52 that substantially do not expand and contract as described above prevents the door body 2 from turning rearward of the maximum up position. In the flap gate 1, while the door body 2 is tilting up from the second position to the maximum up position, the tilt-down moment produced by the tilt-down elastic members 51 acts on the door body 2. This reduces the tilt-up speed of the door body 2. Accordingly, it is possible to reduce force that is applied to the tilt-up limit members 52 or other members when the door body 2 tilts up to the maximum up position. When the door body 2 has tilted up to the second position as illustrated in FIG. 12, the water surface of the water 90 is located below the movable end portion 24 (i.e., canopy) of the door body 2. Thus, even if the tilt-up speed of the door body 2 is reduced, the water 90 will not flow in from the opening 92 beyond the movable end portion 24 of the door body 2.

When the water level on the front side of the door body 2 has started to drop from the level illustrated in FIG. 14, the door body 2 starts to tilt down due to the tilt-down moment produced by the tilt-down elastic members 51. When the angle of the door body 2 becomes less than 90 degrees, the tilt-down moment produced by the weight of the door body 2 also acts on the door body 2. While the door body 2 is tilting down from the maximum up position to the second position, in addition to the tilt-down moment produced by the weight of the door body 2, the tilt-down moment produced by the tilt-down elastic members 51 continues to act on the door body 2. This assists the tilt-down of the door body 2 and allows the door body 2 to speedily start to tilt down after the water level of the water 90 has started to drop. Accordingly, it is possible to prevent the door body 2 from abruptly tilting down as a result of the door body 2 starting to tilt down after a large drop in the water level of the water 90.

When the door body 2 has further tilted down from the second position illustrated in FIG. 12, the tilt-down elastic members 51 are loosened, and accordingly no moment is applied from the tilt-down elastic members 51 to the door body 2. When the door body 2 has tilted down to the first position illustrated in FIG. 11, the door body 2 comes in contact with the upper end portions of the tilt-up elastic members 41, and the tilt-up elastic members 41 start to be contracted. While the door body 2 is tilting down from the first position to the down position illustrated in FIG. 10, the tilt-up moment produced by the tilt-up elastic members 41 continues to act on the door body 2. This reduces the tilt-down speed of the door body 2. Accordingly, it is possible to reduce force that is applied to the floor surface 91 or other members when the door body 2 tilts down to the down position. The tilt-down elastic members 51 are folded in two in the central portion in the longitudinal direction, together with the tilt-up limit members 52.

As described above, the flap gate 1 includes the door body 2 and the flap ancillary part 3. When the door body 2 is in the down position, the movable end portion 24 of the door body 2 is located forward of the supported end portion 23. The door body 2 changes its position between the down position and the maximum up position by turning on the supported end portion 23 serving as a support. The flap ancillary part 3 applies the tilt-up moment to the door body 2 only when the door body 2 is located in a position between the down position and the first position (i.e., position between the down position and the maximum up position). The flap ancillary part 3 applies the tilt-down moment to the door body 2 only when the door body 2 is located in a position between the maximum up position and the second position (i.e., position between the first position and the maximum up position). This simplifies the structure of the flap gate 1 as compared with the case where the structure is such that moment is always applied to the door body, irrespective of the position of the door body. As a result, it is possible to reduce the manufacturing cost of the flap gate 1 that can speedily start to tilt up when water flows in and that can early start to tilt down when the water level has started to drop.

In the flap gate 1, the flap ancillary part 3 is located on the lower side of the upper surface (i.e., first main surface 21) of the door body 2 that is in the down position. Accordingly, the size of the flap gate 1 can be reduced as compared with the case where the flap ancillary part 3 is disposed on either side of the door body 2 (i.e., outside the door body 2 in the width direction). As a result, it is possible to reduce the installation area of the flap gate 1.

In the flap gate 1, the flap ancillary part 3 may be disposed toward the center of the door body 2 in the width direction, rather than on either side of the door body 2. Accordingly, it is possible to increase force that is applied from the flap ancillary part 3 to the door body 2, as compared with the case where force is applied to only the opposite side portions of the movable end portion of the door body when moment for assisting tilt-up or tilt-down is applied to the door body 2. In the case where a comparable level of force is applied to the door body 2, it is possible to increase the span length of the door body 2 (i.e., the width of the door body 2), as compared with the case where force is applied to only the opposite side portions of the movable end portion of the door body. It is also possible to reduce the sizes of members in the vicinity of the movable end portion 24 of the door body 2 and to reduce the manufacturing cost of the flap gate 1.

As described above, the flap ancillary part 3 is located inside the door body 2 that is in the down position. This eliminates the need to form a hole or the like for housing the flap ancillary part 3 in the bottom surface of the recess 93 (i.e., floor surface 91). There is also no need to provide a drainage system such as the aforementioned hole. This facilitates the installation and maintenance of the flap gate 1.

The flap ancillary part 3 includes a tilt-up elastic member 41 that is fixed to the floor surface 91. When the door body 2 is located in a position between the down position and the first position, the tilt-up elastic member 41 is contracted in the up-down direction. This simplifies the structure of the tilt-up ancillary part 4 of the flap ancillary part 3. As a result, it is possible to reduce the manufacturing cost of the flap gate 1.

In the flap ancillary part 3, the tilt-up elastic member 41 does not necessarily have to be fixed to the floor surface 91. For example, the upper end portion of the tilt-up elastic member 41 may be fixed to the door body 2. In this case, the lower end portion of the tilt-up elastic member 41 is a free end that is not fixed to the floor surface 91. That is, the tilt-up elastic member 41 is fixed to only either of the floor surface 91 and the door body 2. When the door body 2 is located in a position between the down position and the first position, the tilt-up elastic member 41 is contracted in the up-down direction. In the flap gate 1, even if the tilt-up elastic member 41 is fixed to the door body 2, the structure of the tilt-up ancillary part 4 of the flap ancillary part 3 can be simplified in the same manner as described above. As a result, it is possible to reduce the manufacturing cost of the flap gate 1.

As described above, the tilt-up elastic member 41 is a coil spring that expands and contracts along the central axis J2. The coil spring includes a plurality of spring elements 411 connected in series. When the coil spring is not expanded, the spring elements 411 to 413 overlap in the direction perpendicular to the central axis J2. Therefore, when the tilt-up elastic member 41 is contracted, its height in the up-down direction can be reduced while the tilt-up moment produced by the tilt-up elastic member 41 is kept at a necessary level. As a result, it is possible to easily dispose the tilt-up elastic member 41 inside the door body 2 that is in the down position.

The flap ancillary part 3 further includes another tilt-up elastic member 41 that is disposed at a different location in the width direction from the location of the one tilt-up elastic member 41. By providing a plurality of tilt-up elastic members 41 in this way, the size of each tilt-up elastic member 41 can be reduced. Also, since a plurality of tilt-up elastic members 41 is aligned in the width direction, it is possible to further increase the span length of the door body 2 and to further reduce the sizes of members in the vicinity of the movable end portion 24 of the door body 2. As a result, the manufacturing cost of the flap gate 1 can be further reduced.

The flap ancillary part 3 further includes a string- or band-like tilt-down elastic member 51 and a string- or band-like tilt-up limit member 52. Opposite end portions of the tilt-down elastic member 51 are fixed respectively to the floor surface 91 and the door body 2. The tilt-down elastic member 51 is a member that is expandable and contractible in the longitudinal direction. Opposite end portions of the tilt-up limit member 52 are fixed respectively to the floor surface 91 and the door body 2. When the door body 2 is located in a position between the second position and the maximum up position, the tilt-down elastic member 51 is expanded. In this way, the tilt-down ancillary part 5 of the flap ancillary part 3 only needs to prepare two types of members, namely the tilt-down elastic member 51 and the tilt-up limit member 52, and the tilt-down ancillary part 5 can be configured by simply fixing the opposite end portions of the two types of members to the floor surface 91 and the door body 2. Accordingly, the structure of the tilt-down ancillary part 5 can be simplified. As a result, it is possible to reduce the manufacturing cost of the flap gate 1. When the door body 2 is in the maximum up position, the tilt-up limit member 52 extends linearly. Accordingly, it is possible with a simple structure to prevent the door body 2 from excessively turning to a position beyond the maximum up position.

The flap ancillary part 3 further includes another tilt-down elastic member 51 that is disposed at a different location in the width direction from the location of the one tilt-down elastic member 51. By providing a plurality of tilt-down elastic members 51 in this way, the size of each tilt-down elastic member 51 can be reduced. Also, since a plurality of tilt-down elastic members 51 is aligned in the width direction, it is possible to further increase the span length of the door body 2 and to further reduce the sizes of members in the vicinity of the movable end portion 24 of the door body 2. As a result, the manufacturing cost of the flap gate 1 can be further reduced.

The flap ancillary part 3 further includes another tilt-up limit member 52 that is disposed at a different location in the width direction from the location of the one tilt-up limit member 52. The other tilt-up limit member 52 is a string- or band-like member having opposite end portions fixed respectively to the floor surface 91 and the door body 2. When the door body 2 is in the maximum up position, the other tilt-up limit member 52 also extends linearly. The aforementioned one tilt-up limit member 52 and the other tilt-up limit member 52 have individually adjustable lengths. Accordingly, the lengths of the tilt-up limit members 52 can be easily made equal. As a result, when the door body 2 is in the maximum up position, approximately an equal level of force can be applied to the plurality of tilt-up limit members 52.

In the flap gate 1, the number of tilt-down elastic members 51 and the number of tilt-up limit members 52 may be the same, or may be different. In the example illustrated in FIG. 2, the tilt-down elastic members 51 and the tilt-up limit members 52 are disposed at the same location in the width direction, but they may be disposed at different locations in the width direction. In this case, the opposite end portions of the tilt-down elastic members 51 in the longitudinal direction are directly fixed respectively to the floor surface 91 and the door body 2 without the intervention of the tilt-up limit members 52. Note that the end portions of the tilt-down elastic members 51 in the longitudinal direction may be indirectly fixed to the floor surface 91 or the door body 2 via a different member other than the tilt-up limit members 52. Also, the end portions of the tilt-up limit members 52 in the longitudinal direction may be indirectly fixed to the floor surface 91 or the door body 2 via a different member.

Figure 16:
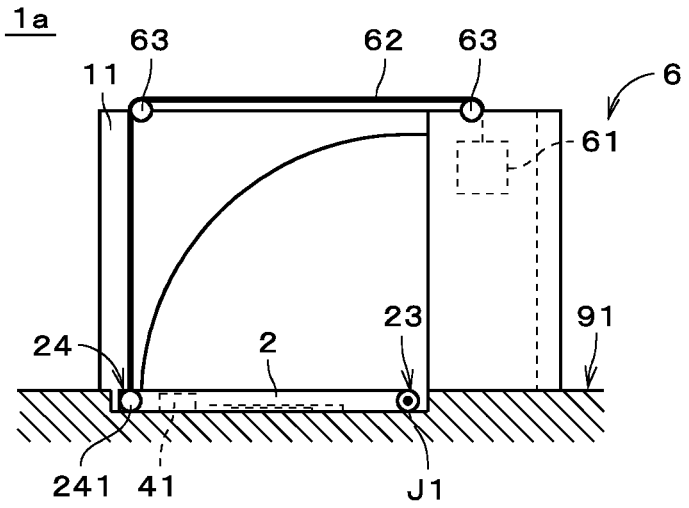
FIG. 16 is a side view of a flap gate according to a second embodiment.
Figure 17:
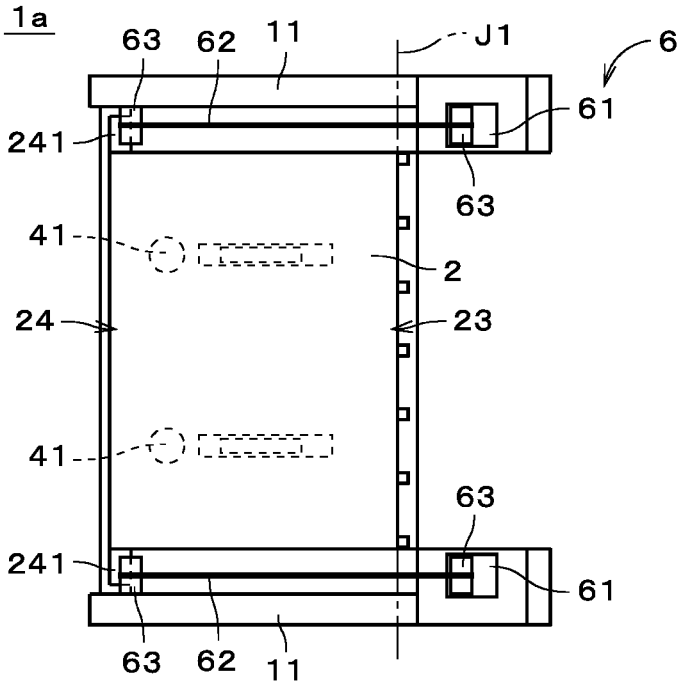
FIG. 17 is a plan view of the flap gate.
Figure 18:
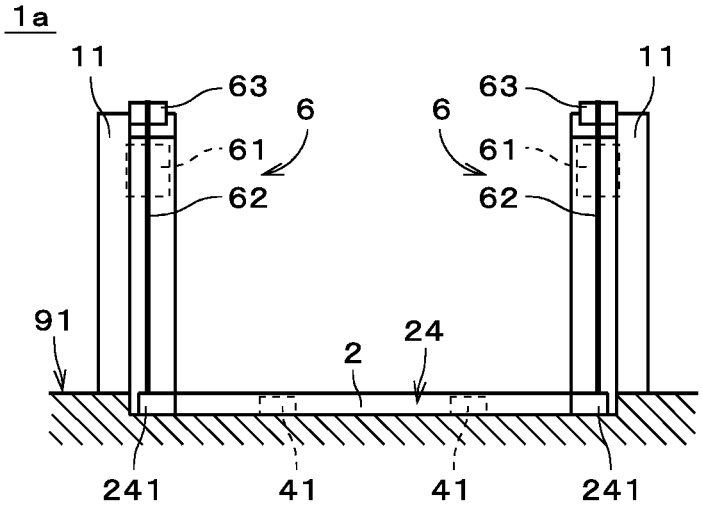
FIG. 18 is a front view of the flap gate.

Next, a flap gate 1*a* according to a second embodiment of the present invention will be described. FIG. 16 is a side view of the flap gate 1*a*. FIG. 17 is a plan view of the flap gate 1*a*. FIG. 18 is a front view of the flap gate 1*a* as viewed from the front. The flap gate 1*a* further includes a counterweight mechanism 6, in addition to the constituent elements of the flap gate 1 illustrated in FIGS. 1 to 3. The structure of the flap gate 1*a* other than the counterweight mechanism 6 is approximately the same as the structure of the flap gate 1 described above. In the following description, constituent elements of the flap gate 1*a* other than the counterweight mechanism 6 are given the same reference signs as the corresponding constituent elements of the flap gate 1.

The counterweight mechanism 6 includes a counterweight 61 and a rope 62 that is a string- or band-like connection member. In the example illustrated in FIGS. 16 to 18, the counterweight mechanism 6 includes two sets of the counterweight 61 and the rope 62. The two counterweights 61 are disposed rearward of the supported end portion 23 of the door body 2 on opposite sides of the door body 2 in the width direction. For example, the counterweights 61 are disposed inside the door abutting parts 11. The counterweights 61 are connected to one ends of the ropes 62.

Each rope 62 extends forward through two fixed pulleys 63 that are aligned in the front-rear direction. For example, the fixed pulleys 63 are fixed to the door abutting parts 11. The other ends of the ropes 62 are connected to the movable end portion 24 of the door body 2 under the front-side fixed pulleys 63. For example, the other ends of the ropes 62 are connected to protrusions 241 of the movable end portion 24 that protrude outward in the width direction. The counterweights 61 are suspended on the ropes 62 and spaced above from the floor surface 91. When the door body 2 is in the down position, the absolute value of the tilt-down moment produced by the weight of the door body 2 is greater than the absolute value of the total of the tilt-up moment produced by the contracted tilt-up elastic members 41 and the tilt-up moment produced by the weights of the counterweights 61.

Figure 19:
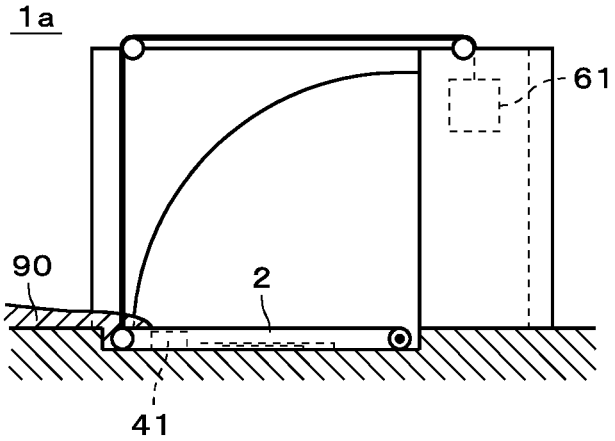
FIG. 19 is a side view of the flap gate.

Next, how the door body 2 of the flap gate 1*a* tilts up will be described with reference to FIGS. 19 to 23. When water 90 flows into the flap gate 1*a* as illustrated in FIG. 19, tilt-up moment is applied to the door body 2 due to, for example, buoyancy exerted on the door body 2 by the water 90, and the door body 2 starts to tilt up. At this time, in addition to the tilt-up moment produced by the water 90, the tilt-down moment produced by the weight of the door body 2, the tilt-up moment produced by the restoring force of the tilt-up elastic members 41, and the tilt-up moment produced by the counterweights 61 (i.e., tilt-up moment produced by the gravity acting on the counterweights 61) act on the door body 2.

Figure 20:
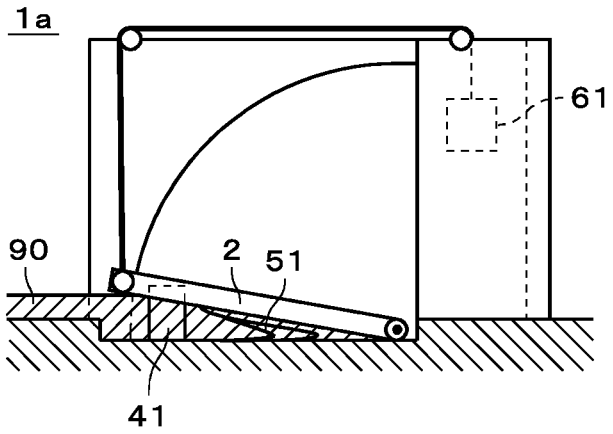
FIG. 20 is a side view of the flap gate.

The tilt-up moment produced by the tilt-up elastic members 41 and the tilt-up moment produced by the counterweights 61 continue to act on the door body 2 until the door body 2 tilts up from the down position to a first position illustrated in FIG. 20. This assists the tilt-up of the door body 2 and increases the tilt-up speed of the door body 2. When the door body 2 is located in a position between the down position and the first position, the absolute value of the tilt-up moment produced by the tilt-up elastic members 41 and the absolute value of the tilt-up moment produced by the counterweights 61 gradually decrease as the angle of the door body 2 increases.

When the door body 2 has further tilted up from the first position, the tilt-up elastic members 41 are separated from the door body 2, and accordingly no moment is applied from the tilt-up elastic members 41 to the door body 2. Even if the door body 2 has further tilted up from the first position, the tilt-up moment produced by the counterweights 61 continues to act on the door body 2. When the door body 2 has tilted up to a second position illustrated in FIG. 21, the tilt-down elastic members 51 extend linearly to their equilibrium lengths.

Figure 21:
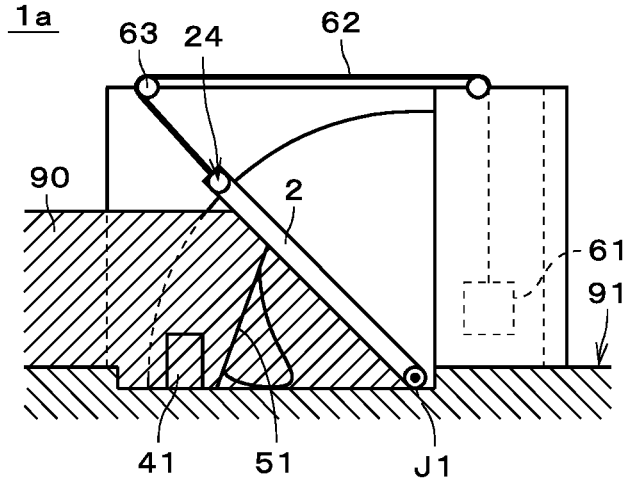
FIG. 21 is a side view of the flap gate.

In the present embodiment, when the door body 2 is in the second position, the door body 2 and each rope 62 that extends from the movable end portion 24 of the door body 2 to the front-side fixed pulley 63 are located in line with each other in side view. In other words, a tangent that extends from the rotation axis J1 of the door body 2 to the lower portion of the front-side fixed pulley 63 overlaps with the door body 2 and the aforementioned rope 62 in side view. Accordingly, the moment applied from the counterweights 61 to the door body 2 becomes substantially zero. The counterweights 61 illustrated in FIG. 21 are located at their lowest points. Even at the lowest points, the counterweights 61 are suspended on the ropes 62 and spaced above from the floor surface 91.

The tilt-up moment produced by the counterweights 61 continues to act on the door body 2 until the door body 2 tilts up from the first position to the second position. When the door body 2 is located in a position between the first position and the second position, the absolute value of the tilt-up moment produced by the counterweights 61 gradually decreases as the angle of the door body 2 increases. Note that the position of the door body 2 at which the moment applied from the counterweights 61 to the door body 2 becomes zero does not necessarily have to be the second position, and may be appropriately changed between the first position and the second position, for example.

Figure 22:
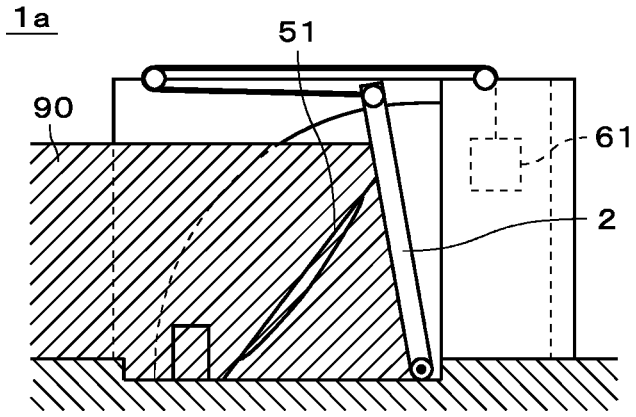
FIG. 22 is a side view of the flap gate.

When the door body 2 has further tilted up from the second position, the tilt-down elastic members 51 are expanded to lengths longer than their equilibrium lengths as illustrated in FIG. 22, and the tilt-down moment produced by the tilt-down elastic members 51 acts on the door body 2. In addition, the tilt-down moment produced by the counterweights 61 (i.e., tilt-down moment produced by the gravity acting on the counterweights 61) acts on the door body 2. When the door body 2 is located in a position between the second position and the maximum up position, the absolute value of the tilt-down moment produced by the tilt-down elastic members 51 and the absolute value of the tilt-down moment produced by the counterweights 61 gradually increase as the angle of the door body 2 increases.

Figure 23:
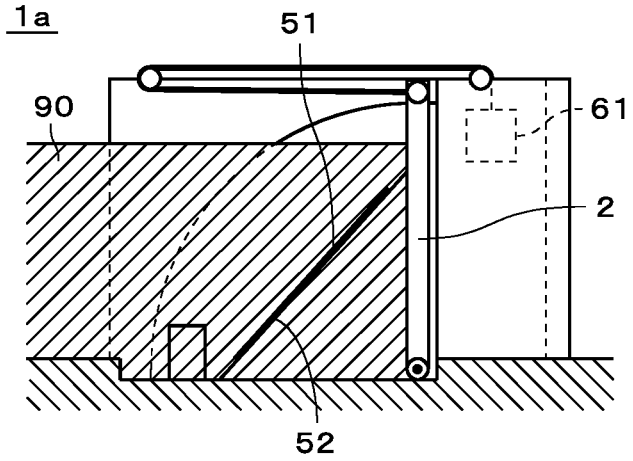
FIG. 23 is a side view of the flap gate.

When the door body 2 has tilted up to the maximum up position as illustrated in FIG. 23, the tilt-up limit members 52 extend linearly without looseness. The tilt-up limit members 52 prevent the door body 2 from turning rearward of the maximum up position. In the flap gate 1*a*, while the door body 2 is tilting up from the second position to the maximum up position, the tilt-down moment produced by the tilt-down elastic members 51 and the tilt-down moment produced by the counterweights 61 act on the door body 2. This reduces the tilt-up speed of the door body 2.

When the water level in front of the door body 2 has started to drop, the door body 2 starts to tilt down due to the tilt-down moment produced by the tilt-down elastic members 51 and the tilt-down moment produced by the counterweights 61. When the angle of the door body 2 becomes less than 90 degrees, the tilt-down moment produced by the weight of the door body 2 also acts on the door body 2. While the door body 2 is tilting down from the maximum up position to the second position illustrated in FIG. 21, in addition to the tilt-down moment produced by the weight of the door body 2, the tilt-down moment produced by the tilt-down elastic members 51 and the tilt-down moment produced by the counterweights 61 continue to act on the door body 2. This assists the tilt-down of the door body 2 and allows the door body 2 to speedily start to tilt down after the water level of the water 90 has started to drop.

While the door body 2 is tilting down from the second position to the first position illustrated in FIG. 20, the tilt-up moment produced by the counterweights 61 acts on the door body 2. This reduces the tilt-down speed of the door body 2. Also, the tilt-down elastic members 51 are loosened, and accordingly no moment is applied from the tilt-down elastic members 51 to the door body 2. When the door body 2 has tilted down to the first position, the door body 2 comes in contact with the upper end portions of the tilt-up elastic members 41, and the tilt-up elastic members 41 start to be contracted. While the door body 2 is tilting down from the first position to the down position illustrated in FIG. 19, the tilt-up moment produced by the tilt-up elastic members 41 and the tilt-up moment produced by the counterweights 61 continue to act on the door body 2. This reduces the tilt-down speed of the door body 2.

In the flap gate 1*a*, as in the flap gate 1 illustrated in FIGS. 1 to 3, the flap ancillary part 3 applies tilt-up moment to the door body 2 only when the door body 2 is located in a position between the down position and the first position. The flap ancillary part 3 also applies tilt-down moment to the door body 2 only when the door body 2 is located in a position between the maximum up position and the second position. Accordingly, it is possible to achieve the flap gate 1*a* that can speedily start to tilt up when water flows into the gate and that can early start to tilt down when the water level has started to drop, while reducing the absolute value of the moment applied from the counterweights 61 to the door body 2. Thus, the weights of the counterweights 61 can be reduced. This increases the span length of the door body 2 (i.e., the width of the door body 2). In addition, it is also possible to reduce the sizes of members in the vicinity of the movable end portion 24 of the door body 2 and to reduce the manufacturing cost of the flap gate 1*a*.

The above-described flap gates 1 and 1*a* can be modified in various ways.

For example, in the flap gates 1 and 1*a*, a hole or the like may be formed in the bottom surface of the recess 93, and the lower portions of the tilt-up elastic members 41 may be housed in this hole or the like. Alternatively, the recess 93 may not be formed in the floor surface 91, and the door body 2 in the down position may be installed on a flat floor surface 91 that is approximately at the same level as the surroundings.

Although each of the tilt-up elastic members 41 has the three spring elements 411 to 413 connected in series by the two connection members 414 and 415 as described above, the structure of the tilt-up elastic members 41 may be changed in various ways. For example, the number of spring elements included in each tilt-up elastic member 41 is not limited to three, and may be appropriately changed within a range greater than or equal to two. The structure in which a plurality of spring elements are connected in series may be appropriately changed.

The tilt-up elastic members 41 are not limited to coil springs in which the spring elements 411 to 413 are connected in series, and may be coil springs having a different shape. The tilt-up elastic members 41 are also not limited to coil springs, and may be other elastic members having various structures. For example, the tilt-up elastic members 41 may be flat springs or helical torsion coil springs.

The tilt-down elastic members 51 are not limited to string- or band-like elastomeric resin members, and may be elastic members having a different shape or a different structure. For example, instead of the band-like tilt-down elastic members 51 illustrated in FIG. 9, opposite end portions of coil springs or opposite end portions of the arms of helical torsion coil springs may be fixed to the tilt-up limit members 52.

Figure 24:
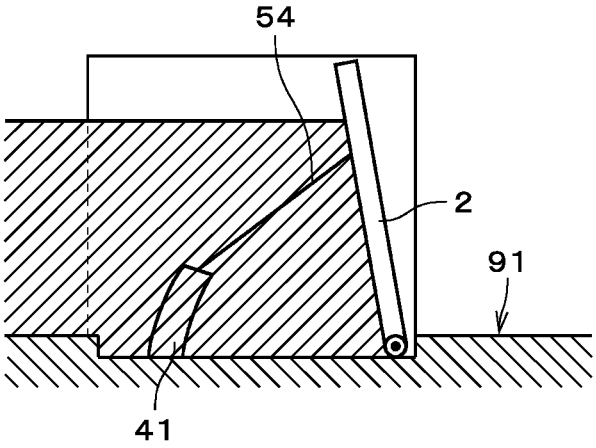
FIG. 24 is a side view showing another example of the flap gate.

The flap ancillary part 3 may employ both of the structure in which tilt-up moment is applied to the door body 2 only when the door body 2 is located in a position between the down position and the first position and the structure in which tilt-down moment is applied to the door body 2 only when the door body 2 is located in a position between the second position and the maximum up position. For example, the upper end portions of the tilt-up elastic members 41 fixed to the aforementioned floor surface 91 may be connected to the door body 2 by the string- or band-like connection members 54 that substantially do not expand and contract. In this case, only when the door body 2 is located in a position between the down position and the first position, tilt-up moment is applied from the contracted tilt-up elastic members 41 to the door body 2. When the door body 2 has further tilted up from the second position, the tilt-up elastic members 41 are pulled and expanded diagonally upward by the door body 2 via the connection member 54 as illustrated in FIG. 24. Accordingly, only when the door body 2 is located in a position between the second position and the maximum up position, tilt-down moment is applied from the expanded tilt-up elastic members 41 to the door body 2.

It is sufficient for the tilt-up ancillary part 4 to apply tilt-up moment to the door body 2 only when the door body 2 is located in a position between the down position and the first position, and the tilt-up ancillary part 4 does not necessarily have to include the tilt-up elastic members 41. It is sufficient for the tilt-down ancillary part 5 to apply tilt-down moment to the door body 2 only when the door body 2 is located in a position between the second position and the maximum up position, and the tilt-down ancillary part 5 does not necessarily have to include the tilt-down elastic members 51 and the tilt-up limit members 52.

The flap ancillary part 3 (i.e., the tilt-up ancillary part 4 and the tilt-down ancillary part 5) does not necessary have to be disposed on the lower side of the upper surface of the door body 2 that is in the down position. For example, part or the whole of the flap ancillary part 3 may be disposed on either side of the door body 2.

The flap gates 1 and 1*a* may omit the tilt-down ancillary part 5 from the flap ancillary part 3. In this case, the flap gates 1 and 1*a* include the door body 2 and the tilt-up ancillary part 4. When the door body 2 is in the down position, the movable end portion 24 of the door body 2 is located forward of the supported end portion 23 in the same manner as described above. The door body 2 changes its position between the down position and the maximum up position by turning on the supported end portion 23 serving as a support. The tilt-up ancillary part 4 applies tilt-up moment to the door body 2 only when the door body 2 is located in a position between the down position and the first position. The tilt-up ancillary part 4 includes the tilt-up elastic members 41 that are disposed on the lower side of the upper surface of the door body 2 in the down position and that are fixed to either of the floor surface 91 and the door body 2. The tilt-up elastic members 41 are contracted in the up-down direction when the door body 2 is located in a position between the down position and the first position. The tilt-up elastic members 41 are coil springs that expand and contract along the central axis J2. Each coil spring includes a plurality of spring elements 411 to 413 connected in series. When the coil springs are not expanded, the spring elements 411 to 413 overlap in a direction perpendicular to the central axis J2. Accordingly, it is possible to simplify the structure of the tilt-up ancillary part 4 and to reduce the manufacturing cost of the flap gate 1 that can speedily start to tilt up when water flows into the gate. It is also possible to reduce the height of the contracted tilt-up elastic members 41 in the up-down direction.

The flap gates 1 and 1*a* may omit the tilt-up ancillary part 4 from the flap ancillary part 3. In this case, the flap gates 1 and 1*a* include the aforementioned door body 2 and the tilt-down ancillary part 5. The tilt-down ancillary part 5 applies tilt-down moment to the door body 2 only when the door body 2 is located in a position between the second position and the maximum up position in the same manner as described above. The tilt-down ancillary part 5 is disposed on the lower side of the upper surface of the door body 2 that is in the down position. The tilt-down ancillary part 5 includes the string- or band-like tilt-down elastic members 51 and the string- or band-like tilt-up limit members 52. Opposite end portions of each tilt-down elastic member 51 are fixed respectively to the floor surface 91 an the door body 2. The tilt-down elastic members 51 are members that are expandable and contractible in the longitudinal direction. Opposite end portions of each tilt-up limit member 52 are fixed respectively to the floor surface 91 and the door body 2. When the door body 2 is located in a position between the second position and the maximum up position, the tilt-down elastic members 51 are expanded. When the door body 2 is in the maximum up position, the tilt-up limit members 52 extend linearly. Accordingly, it is possible to simplify the structure of the tilt-down ancillary part 5 and to reduce the manufacturing cost of the flap gate 1 that can early start to tilt down when the water level has started to drop. In addition, it is also possible with a simple structure to prevent the door body 2 from excessively turning to a position beyond the maximum up position.

The structures of the flap gates 1 and 1*a* may be applied to flap gates other than the flap gates (so-called floating body type flap gates) in which the door body 2 automatically tilts up under water pressure. For example, the structures of the above-described flap gates 1 and 1*a* may be applied to flap gates in which the door body 2 is manually caused to tilt up, or to flap gates in which the door body 2 is caused to tilt up by a mechanism such as a hydraulic cylinder or a motor-operated jack.

The configurations of the above-described preferred embodiments and variations may be appropriately combined as long as no mutual inconsistencies arise.

While the invention has been shown and described in detail, the foregoing description is in all aspects illustrative and not restrictive. It is therefore to be understood that numerous modifications and variations can be devised without departing from the scope of the invention.

REFERENCE SIGNS LIST

1, 1*a* Flap gate
2 Door body
3 Flap ancillary part
4 Tilt-up ancillary part
5 Tilt-down ancillary part
21 First main surface (of the door body)
23 Supported end portion
24 Movable end portion
41 Tilt-up elastic member
51 Tilt-down elastic member
52 Tilt-up limit member
91 Floor surface
92 Opening
411 to 413 Spring element
J1 Rotation axis
J2 Central axis

The invention claimed is:

1. A flap gate provided in an opening and configured to tilt up to block said opening when water flows in from said opening, the flap gate comprising:

a door body whose movable end portion is located forward of a supported end portion, the movable end portion being on a side from which water flows in, when said door body is in a down position, and the door body being configured to change position between said down position and a maximum up position by turning on said supported end portion serving as a support; and a flap ancillary part that applies tilt-up moment to said door body only when said door body is located in a position between said down position and a first position that is between said down position and said maximum up position, and applies tilt-down moment to said door body only when said door body is located in a position between said maximum up position and a second position that is between said first position and said maximum up position, wherein when said door body is located in a position between said first position and said second position, tilt-up moment produced by the water and not any portion of the flap ancillary part, and tilt-down moment produced by the weight of said door body act on said door body.

2. The flap gate according to claim 1, wherein said flap ancillary part is disposed on a lower side of an upper surface of said door body that is in said down position.

3. The flap gate according to claim 1, wherein said flap ancillary part includes a tilt-up elastic member that is fixed to either a floor surface or said door body, and said tilt-up elastic member is contracted in a downward direction when said door body is located in a position between said down position and said first position.

4. The flap gate according to claim 3, wherein said tilt-up elastic member is a coil spring that expands and contracts along a central axis, and said coil spring includes a plurality of spring elements that are connected in series and that overlap in a direction perpendicular to said central axis when said coil spring is not expanded.

5. The flap gate according to claim 1, wherein said flap ancillary part includes:

a tilt-down elastic member that is a string- or band-like elastomeric resin member having opposite end portions fixed respectively to a floor surface and said door body and that is expandable and contractible in a longitudinal direction; and a string- or band-like tilt-up limit member having opposite end portions fixed respectively to said floor surface and said door body, said tilt-down elastic member is expanded when said door body is located in a position between said second position and said maximum up position, and said tilt-up limit member extends linearly when said door body is in said maximum up position.

6. The flap gate according to claim 5, wherein said flap ancillary part further includes another tilt-up limit member that is disposed at a different location in a width direction from a location of said tilt-up limit member, said another tilt-up limit member is a string- or band-like member having opposite end portions fixed respectively to said floor surface and said door body, said another tilt-up limit member extends linearly when said door body is in said maximum up position, and said tilt-up limit member and said another tilt-up limit member have individually adjustable lengths.

7. The flap gate according to claim 1, wherein the door body is constructed and arranged to change position between the down position and the maximum up position responsive to the water flowing in from the opening.

8. The flap gate according to claim 1, wherein the door body comprises a floating part that provides a tilt up moment responsive to water flowing in from the opening.

9. A flap gate provided in an opening and configured to tilt up to block said opening when water flows in from said opening, the flap gate comprising:

a door body whose movable end portion is located forward of a supported end portion when said door body is in a down position, and the door body being configured to change position between said down position and a maximum up position by turning on said supported end portion serving as a support; and a tilt-down ancillary part that applies tilt-down moment to said door body only when said door body is located in a position between said maximum up position and a second position that is between said down position and said maximum up position, wherein said tilt-down ancillary part is disposed on a lower side of an upper surface of said door body that is in said down position, said tilt-down ancillary part includes:

a tilt-down elastic member that is a string- or band-like elastomeric resin member having opposite end portions fixed respectively to a floor surface and said door body, and that is expandable and contractible in a longitudinal direction; and a tilt-up limit member that is a string or band-like member having opposite end portions fixed respectively to said floor surface and said door body, said tilt-down elastic member is expanded when said door body is located in a position between said second position and said maximum up position, and said tilt-up limit member extends linearly when said door body is in said maximum up position.

10. A flap gate provided in an opening and configured to tilt up to block said opening when water flows in from said opening, the flap gate comprising:

a door body whose movable end portion is located forward of a supported end portion, the movable end portion being on a side from which water flows in, when said door body is in a down position, and the door body being configured to change position between said down position and a maximum up position by turning on said supported end portion serving as a support; and a flap ancillary part configured to apply tilt-up moment to said door body only when said door body is located in a position between said down position and a first position that is between said down position and said maximum up position, applies tilt-down moment to said door body only when said door body is located in a position between said maximum up position and a second position that is between said first position and said maximum up position, wherein the flap ancillary part does not apply any tilt-up moment or tilt-down moment when said door body is located in a position between said first position and said second position.

* * * * *